US005964011A

United States Patent [19]

Ruston et al.

[11] Patent Number: 5,964,011

[45] Date of Patent: Oct. 12, 1999

[54] ADJUSTABLE CASEMENT WINDOW HINGE

[75] Inventors: David John Ruston, Rockford; Elizabeth Rebecca Lisiecki, Streamwood, both of Ill.

[73] Assignee: Newell Operating Company, Freeport, Ill.

[21] Appl. No.: 08/928,961

[22] Filed: Sep. 12, 1997

[51] Int. Cl.[6] ..... E05D 7/06

[52] U.S. Cl. ..... 16/239; 16/242; 16/362

[58] Field of Search ..... 16/239, 241, 235, 16/240, 242, 366, 362, 368, 371, DIG. 34; 49/396, 246, 750

[56] References Cited

U.S. PATENT DOCUMENTS

| | | | |
|---|---|---|---|
| Re. 32,846 | 1/1989 | Sandberg et al. . | |
| Re. 34,230 | 4/1993 | Tucker et al. . | |
| Re. 34,657 | 7/1994 | La See . | |
| Re. 35,635 | 10/1997 | Bauman . | |
| 1,044,055 | 11/1912 | Johnson et al. . | |
| 1,336,174 | 4/1920 | Way | 16/242 |
| 1,499,540 | 7/1924 | Lea . | |
| 1,710,171 | 4/1929 | Lindsay . | |
| 2,688,778 | 9/1954 | Westman . | |
| 2,724,144 | 11/1955 | Lohrman | 16/129 |
| 2,926,397 | 3/1960 | Vuncannon | 16/370 |
| 2,994,907 | 8/1961 | Hammond . | |
| 3,006,443 | 10/1961 | Siler | 189/36 |
| 3,097,402 | 7/1963 | Ewing | 20/42 |
| 3,234,584 | 2/1966 | Valade | 16/DIG. 34 |
| 3,838,537 | 10/1974 | Stavenau et al. . | |
| 4,106,876 | 8/1978 | Tregoning | 403/4 |
| 4,266,591 | 5/1981 | F'Geppert | 411/167 |
| 4,448,563 | 5/1984 | Zankl | 403/161 |
| 4,478,455 | 10/1984 | Linde | 297/362 |
| 4,593,431 | 6/1986 | Sandberg et al. | 16/381 |
| 4,674,149 | 6/1987 | Vetter . | |
| 4,677,707 | 7/1987 | Holler | 16/239 |
| 4,689,852 | 9/1987 | Buckley | 16/341 |
| 4,726,092 | 2/1988 | Tacheny et al. . | |
| 4,790,106 | 12/1988 | La See . | |
| 4,833,754 | 5/1989 | Yang . | |
| 4,986,028 | 1/1991 | Schneider et al. . | |
| 4,997,303 | 3/1991 | Xu et al. | 403/4 |
| 5,074,075 | 12/1991 | La See . | |
| 5,152,102 | 10/1992 | La See . | |
| 5,155,960 | 10/1992 | Shaanan | 52/584 |
| 5,307,539 | 5/1994 | Bauman . | |
| 5,491,930 | 2/1996 | La See . | |

FOREIGN PATENT DOCUMENTS

| | | | |
|---|---|---|---|
| 2379680 | 10/1978 | France | 16/235 |
| 376488 | 7/1932 | United Kingdom | 16/241 |
| 1137878 | 12/1968 | United Kingdom | 16/241 |
| 1222996 | 2/1971 | United Kingdom . | |

*Primary Examiner*—Chuck Y. Mah
*Attorney, Agent, or Firm*—Foley & Lardner

[57] ABSTRACT

An apparatus is disclosed for correcting misalignment problems in a casement window. An adjustment stud is included in an improved casement window unit. The adjustment stud includes a tenon mounted on a track assembly and a post to which a sash arm is rotatably attached. The tenon and post are eccentric with respect to one another. When alignment problems occur the central axis of the post may be rotated about the central axis of the tenon to a desired orientation such that the alignment problem is corrected.

19 Claims, 5 Drawing Sheets

FIG. 1
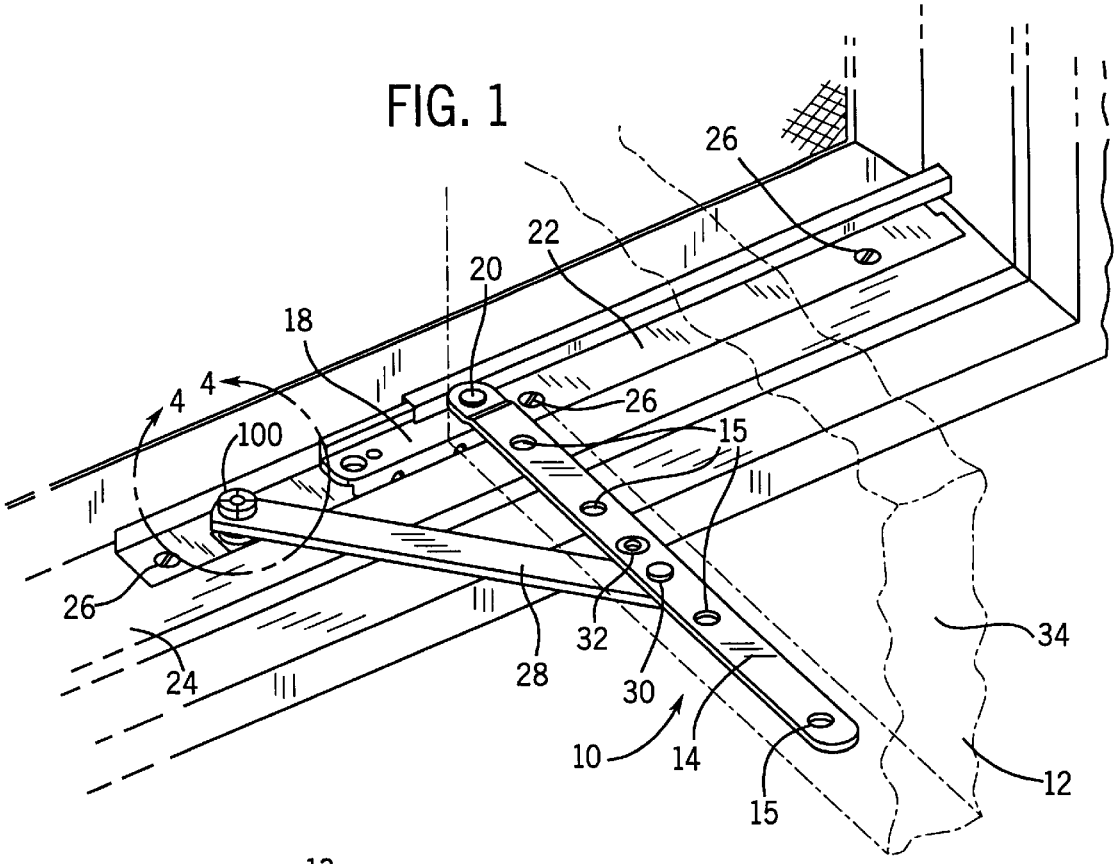
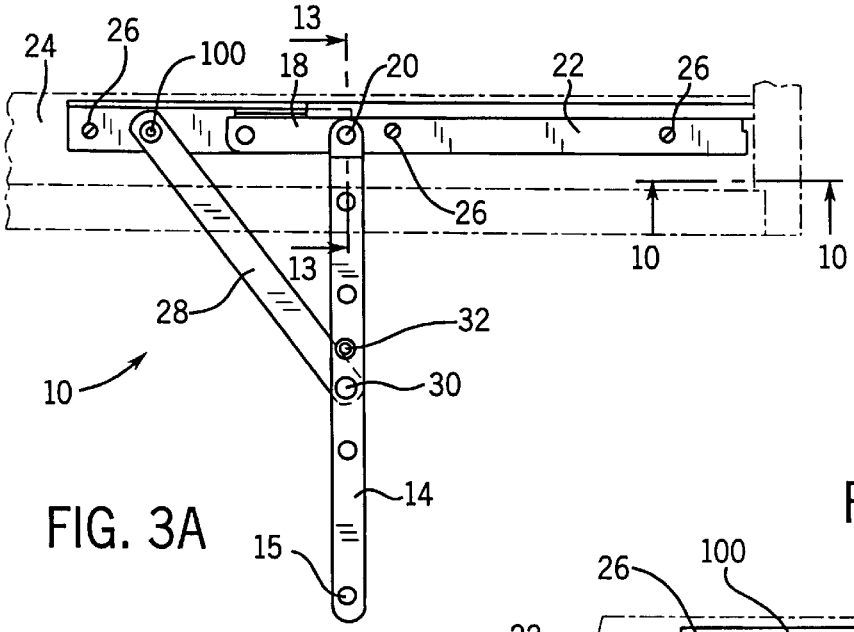
FIG. 3A
FIG. 3C
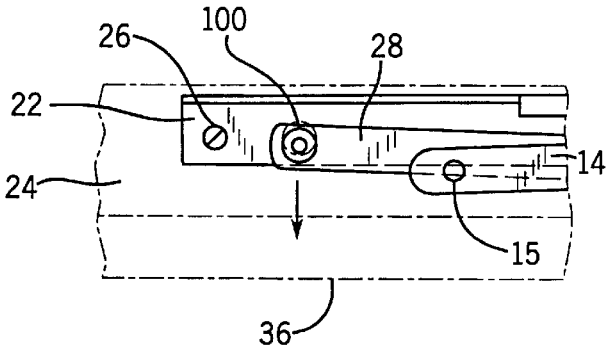

FIG. 4
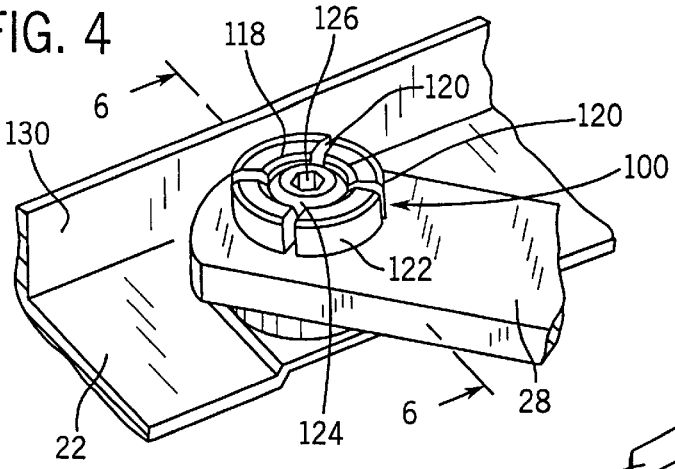
FIG. 5
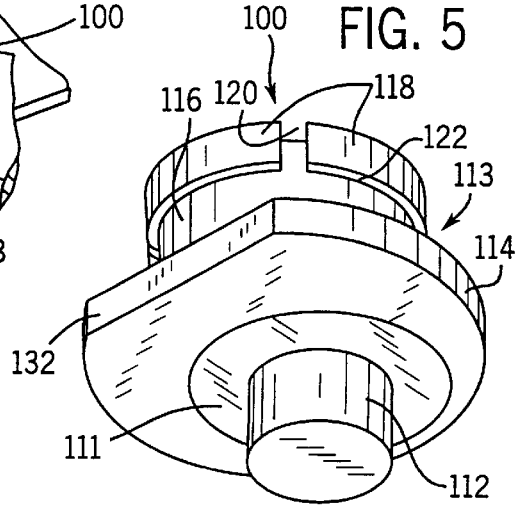
FIG. 6
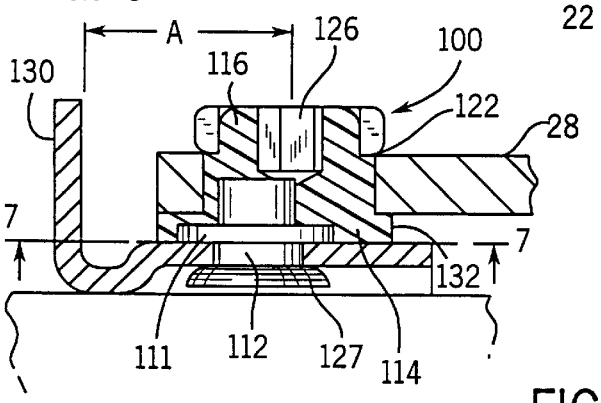
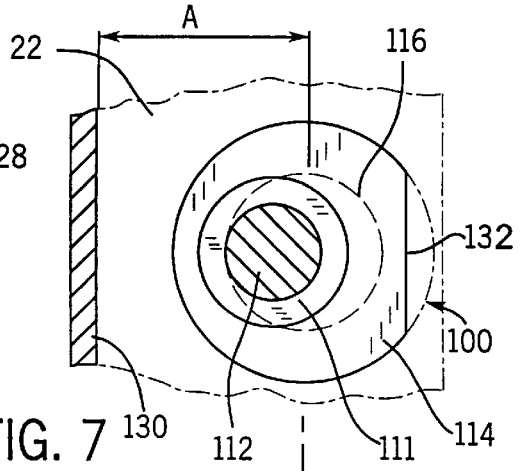
FIG. 7
FIG. 8
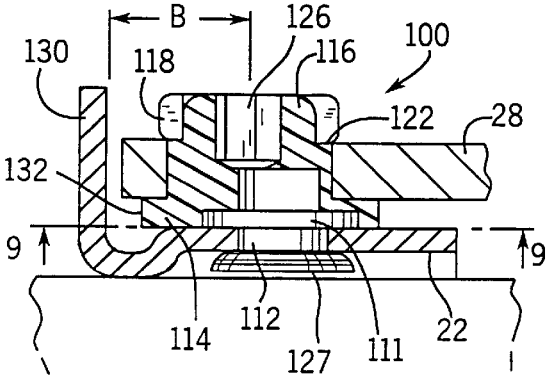
FIG. 9
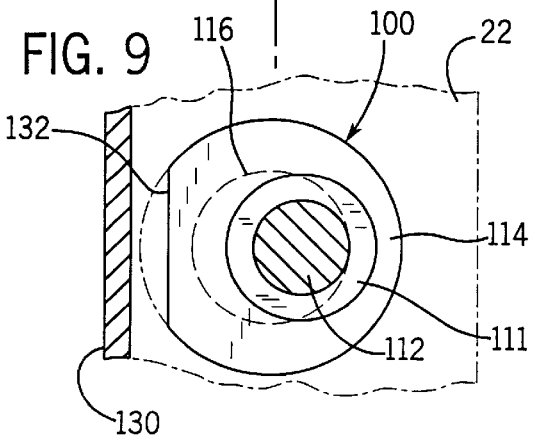

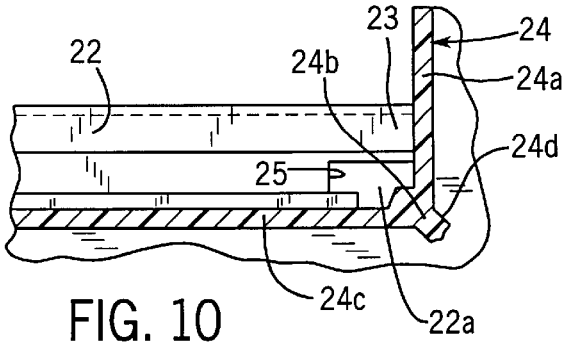
FIG. 10
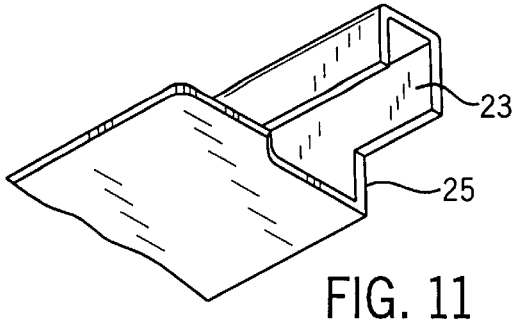
FIG. 11
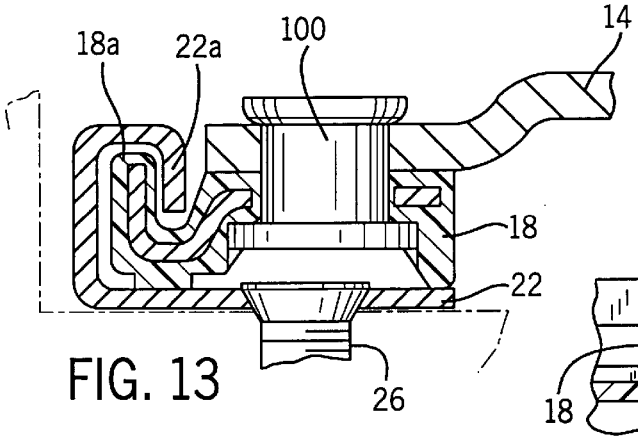
FIG. 13
FIG. 12
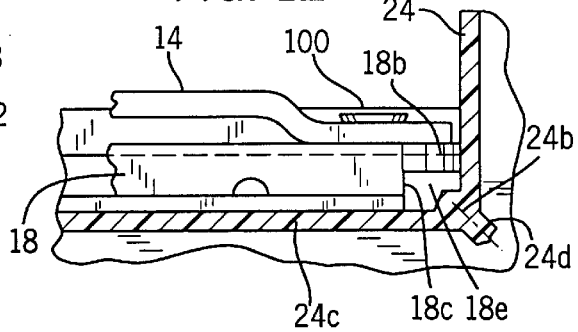
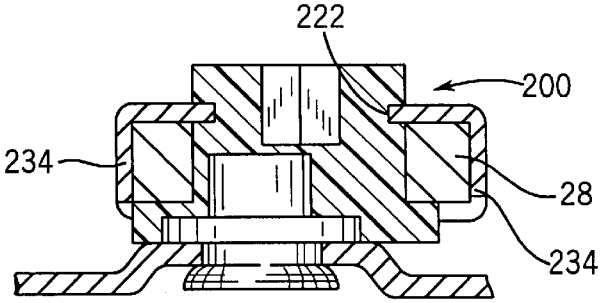
FIG. 16
FIG. 17
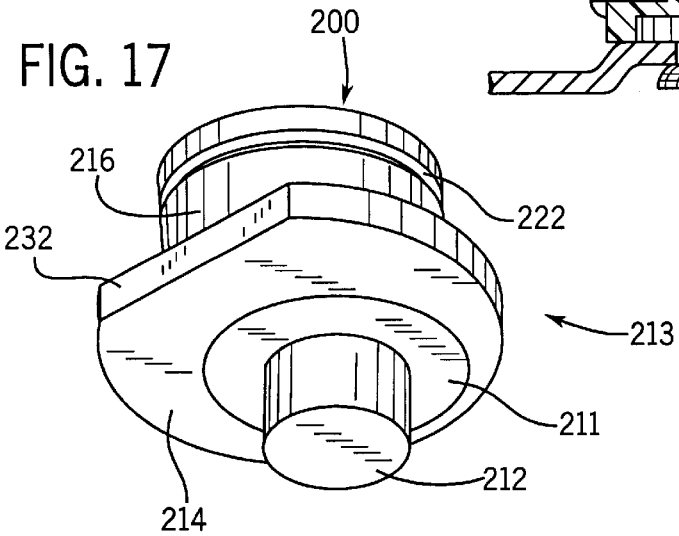

FIG. 14
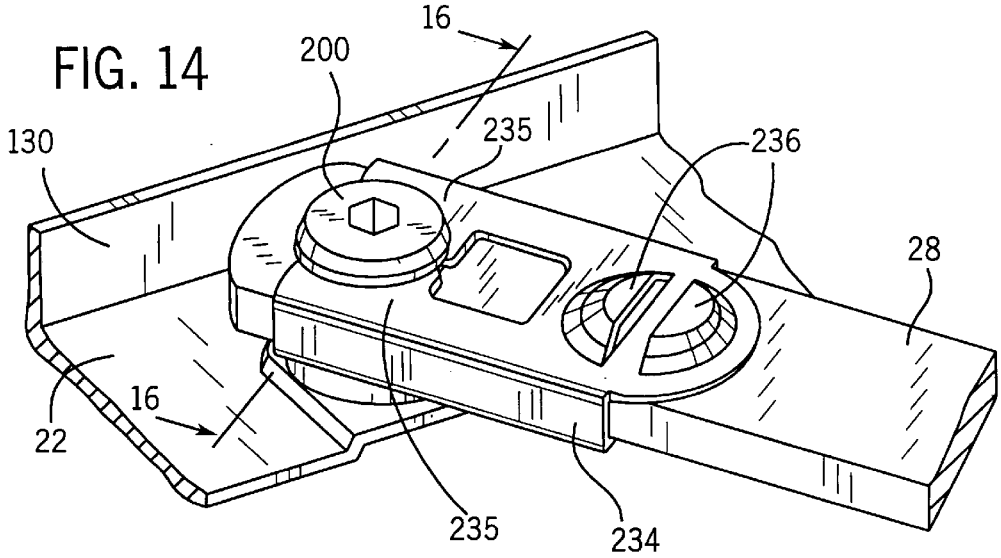
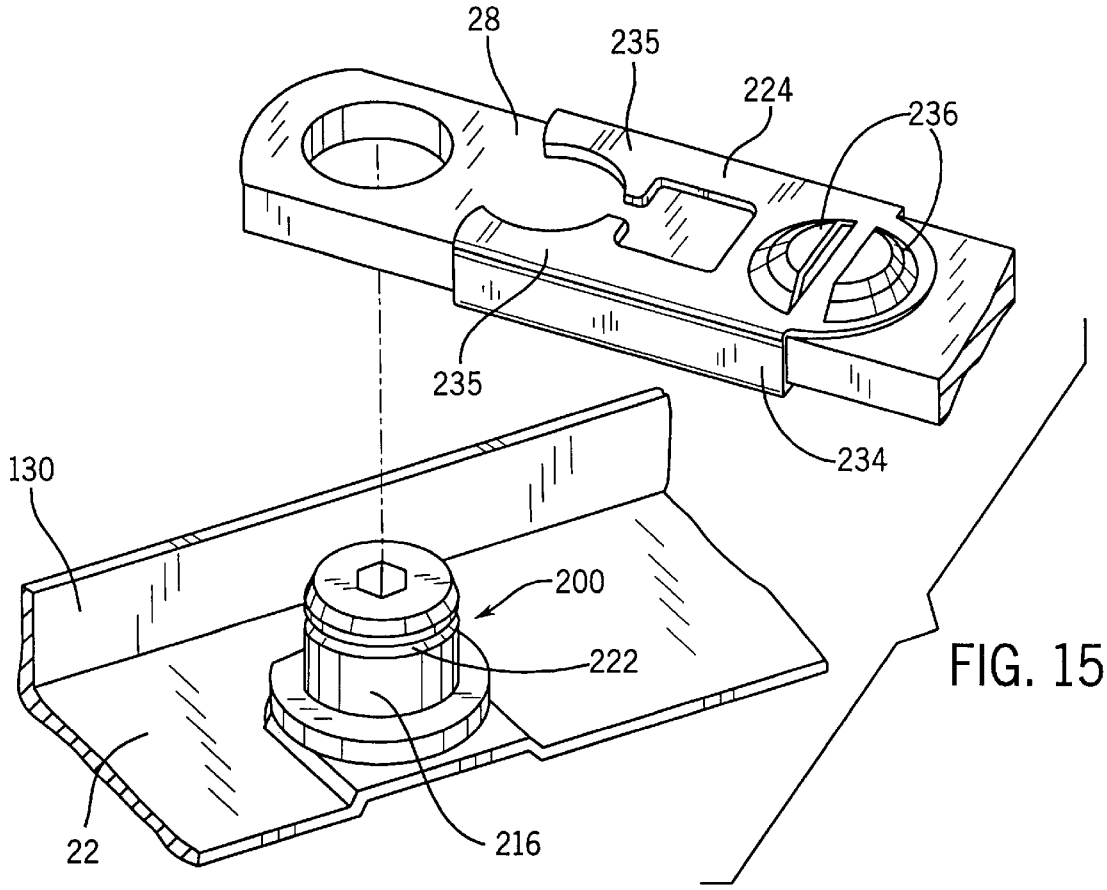
FIG. 15

ADJUSTABLE CASEMENT WINDOW HINGE

FIELD OF THE INVENTION

The present invention relates to a hinge for a casement window. In particular, the present invention relates to an adjustment stud that acts as a hinge pivot point and is adjustable to overcome sash sag.

BACKGROUND OF THE INVENTION

Casement windows commonly have a window sash movably mounted in a frame using a system of links and pivot points. The window is opened as the sash pivots and translates within the frame. Many casement windows have a track mounted in the window frame on which runs a shoe assembly, connected with a sash arm, that guides the window sash during its travel from an open to a closed position. The track and shoe assembly guide the window sash in its translation. Casement windows often use pivots that are typically mounted, adjacent one end of the track, and formed to rotatably retain a swivel arm on one end. The swivel arm is further rotatably interconnected, on a second end, to a sash arm by a pivot. The pivots and arm links control the rotation of the window sash.

The hinge, as a whole, maintains the relationship of the sash to the window frame. For the casement window to close and seal effectively, proper positioning of the hinge pivots must be maintained. When one or more of the hinge pivots are not properly positioned, the window sash is misaligned with respect to the window frame. Over the life of the window, effective closure and sealing may be impaired by shifting of the window frame or the window sash and wear in the linkages. This misalignment of the window sash with the window frame is commonly referred to as "sash sag".

"Sash sag" can be corrected by the slight repositioning of a pivot. This repositioning has been accomplished in the past by using a slotted hole on a track assembly. A pivot, for the swivel arm, is secured to the track assembly by a screw that engages the slotted hole. When "sash sag" occurs, the screw is loosened and the pivot is moved to a new location, thereby reducing the "sash sag". Repeated adjustment of the hinges tends to put substantial wear on the pivot mount and the pivot mounting hardware, thereby reducing the useable life of the hardware. Also, repeated loosening and tightening of the screws has shown to be cumbersome when making small adjustments.

More recently, eccentric shaped adjustable pivots have been used to provide for adjustment of a casement window hinge to reduce "sash sag" or correct any other alignment problems. Eccentric shaped adjustable pivots of this type typically include a stud, having a flange with surfaces for engaging an adjustment tool, having a pivot portion, about which the swivel arm pivots, and an eccentric neck, frictionally secured to the window frame or the track, about which the pivot axis rotates when the alignment is adjusted. A window hinge of this type is shown in U.S. Pat. No. 5,307,539 issued to Bauman. The Bauman patent discloses a stud which requires a wrench engaging a flange for making alignment adjustments. Having this tool engagement site makes it necessary for an adjuster to engage the wrench roughly perpendicular to the hinge axis. Because of the tight spaces associated with casement window hardware, this may not be convenient.

Other known hinge pivots require disassembling the track assembly in order to adjust the pivot position to correct "sash sag". In this design, discrete hinge pivot positions are indexed by engagement of an index cam with a cam-engaging element. The index cam is further interconnected with a link engaging pivot. The cam-engaging element may be a part of the track assembly. When readjustment of the link engaging pivot is desired, the track must be disassembled, the index cam must be reoriented with respect to the cam-engaging element, and the track must then be reassembled. U.S. Pat. No. Re. 34,657 issued to La See suggests an adjustable pivot of this type.

Accordingly, it would be advantageous to provide a hinge that is not required to be in one of a limited number of discrete positions and which is easily adjustable. It would also be advantageous to provide an adjustable pivot having a tool access position in which the tool is engageable, with the adjustment stud, roughly parallel to the pivot axis, providing simplified access to the adjustment stud because the tool access region is located at the exposed end of the post. It would further be advantageous to provide an adjustable pivot having an indicator that helps to visually indicate the rotational position of the stud. For example, the indicator may be a flat side of a partially circular flange. It would further be advantageous to provide an adjustment stud having a tenon mounted in the track assembly using a frictional fit or an interference fit. This allows the adjustment stud to be rotated 360 degrees and set at any position therein. Using a frictional fit also provides for a simplified and cost effective assembly whereby the tenon is simply press fit into an aperture in the track assembly. It would further be advantageous to provide an adjustment stud that may be manufactured to improve performance and cost either as a single-member stud or as a multi-member stud, depending on the needs of the application. Manufacturing a multi-member stud allows a designer to choose different materials to be used for manufacturing the different members, depending on the desired performance characteristics. For example the tenon could be made from a different material than the post or the tool access region. It would further be advantageous to provide an adjustment stud that can easily eliminate "sash sag" through a simple adjustment to the adjustment stud.

SUMMARY OF THE INVENTION

The present invention relates to an apparatus for retaining at least two linkages in rotational relation to one another, the apparatus having a first linkage with at least one substantially circular aperture, a second linkage with at least one substantially circular aperture, and an adjustment stud. The adjustment stud including a substantially cylindrical post having a first end, a second end, and defining a pivot axis extending centrally and longitudinally through both the first end and the second end, a substantially cylindrical tenon having a first end, a second end, and defining an adjustment axis extending centrally and longitudinally through both the first end and the second end. The post and the tenon are interconnected adjacent their respective second ends such that the pivot axis and adjustment axis are substantially parallel and eccentric with respect to one another, the first end of the post extends through the aperture in the first linkage, the post is held in pivotable retention, the first end of the tenon extends through the aperture in the second linkage, the tenon is frictionally bound from freely rotating, in relation to the second linkage, and the stud is selectively and continuously adjustable by rotation of the stud in relation to the second linkage under a substantial torque.

The present invention also relates to an adjustment stud for the adjustment of a casement window to reduce sash sag, the adjustment stud being frictionally retained from free rotational motion in a window track, but adjustably rotatable under substantial torque, and the adjustment stud pivotally retaining a swivel arm. The adjustment stud includes a substantially cylindrical post having a first end, a second end, and defining a pivot axis extending centrally and longitudinally through both the first end and the second end, and having a first end formed to engage an adjustment tool. The adjustment stud also includes a substantially cylindrical tenon having a first end, a second end, and defining an adjustment axis extending centrally and longitudinally through both the first end and the second end. The post and the tenon are interconnected adjacent their respective second ends such that the pivot axis and adjustment axis are substantially parallel and eccentric with respect to one another.

The present invention further relates to a hinge for a casement window of a type including a frame and a sash rotatable within the frame. The hinge includes a track assembly, attachable to a window frame and having at least one substantially circular aperture, a swivel arm, having at least one substantially circular aperture, and an adjustment stud. The adjustment stud includes a substantially cylindrical post having a first end, a second end, and defining a pivot axis extending centrally and longitudinally through both the first end and the second end, a substantially cylindrical tenon having a first end, a second end, and defining an adjustment axis extending centrally and longitudinally through both the first end and the second end. The post and the tenon are interconnected adjacent their respective second ends such that the pivot axis and adjustment axis are substantially parallel and eccentric with respect to one another. The first end of the post extends through the aperture in the swivel arm. The post is held in pivotable retention with the swivel arm. The first end of the tenon extends through the aperture in the track assembly. The tenon is frictionally bound from freely rotating, in relation to the track assembly, and the stud is selectively and continuously adjustable by rotation of the pivot axis around the adjustment axis under a substantial torque.

BRIEF DESCRIPTION OF THE DRAWINGS

FIG. 1 is a cutaway perspective view of a casement window (with a sash and a frame) depicting an exemplary embodiment of a hinge assembly of the casement window unit.

FIG. 3A is a top plan view of the hinge assembly with the window in an open position.

FIGS. 3B through 3D are partial top plan views of the hinge assembly with the adjustment stud in different orientations and depicting different sash and frame alignments.

FIG. 4 a perspective view of the region defined by the line 4—4 in FIG. 1 depicting an adjustment stud according to an exemplary embodiment.

FIG. 5 is a perspective view of the adjustment stud depicted in FIG. 4.

FIG. 6 is a cross-sectional elevation view taken along line 6—6 in FIG. 4.

FIG. 7 is a bottom plan view of the adjustment stud depicting the stud in the orientation shown in FIGS. 6 and 3C.

FIG. 8 is a cross-sectional elevation view similar to FIG. 6 but depicting the adjustment stud in a different orientation.

FIG. 9 is a bottom plan view of the adjustment stud, similar to FIG. 7, depicting the adjustment stud in the orientation shown in FIGS. 8 and 3D.

FIG. 10 is a cross-sectional elevation view taken along line 10—10 in FIG. 3A partially depicting the window frame and track.

FIG. 11 is a partial perspective view of the track shown in FIG. 10.

FIG. 12 is a cross-sectional elevation view taken along line 12—12 in FIG. 3B.

FIG. 13 is a cross-sectional elevation view taken along line 13—13 in FIG. 3A.

FIG. 14 is a partial perspective view of an alternate embodiment of the invention depicting the swivel arm engaging the adjustment stud using a clip.

FIG. 15 is a partial perspective view of the embodiment depicted in FIG. 14 with the swivel arm disengaged from the adjustment stud.

FIG. 16 is a cross-sectional elevation view taken along line 16—16 in FIG. 14.

FIG. 17 is a perspective view of the alternate embodiment of the adjustment stud depicted in FIGS. 14 through 16.

DETAILED DESCRIPTION OF THE PREFERRED EMBODIMENTS

Figure 2:
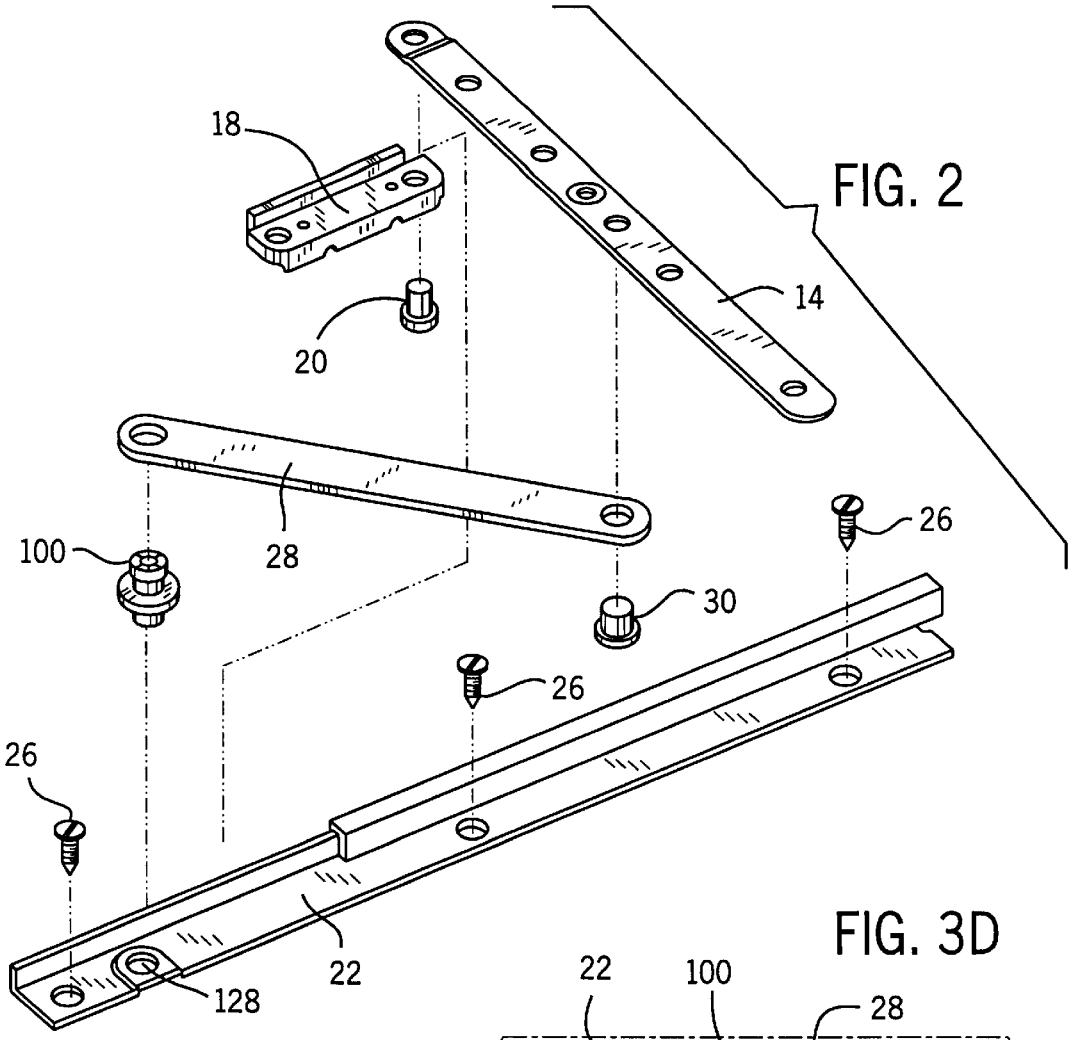
FIG. 2 is an exploded perspective view of the hinge assembly.

FIG. 1 is a casement window according to a preferred embodiment of the present invention. Depicted in FIGS. 1 and 3A, is a casement window 10 that facilitates the opening and closing of a window sash 12. Window 10 includes window sash 12 (shown in phantom lines) mounted to a sash arm 14 by fasteners (e.g., mounting screws) that extend through apertures (shown by reference numeral 15) into the window sash. Sash arm 14 of window 10 is connected at one end to a shoe assembly 18 by a shoe pivot (shown as rivet 20). Shoe assembly 18 is at least partially retained to slide within and along a track assembly 22. Track assembly 22 is mounted to window frame 24 using fasteners (shown as screws 26). A swivel arm 28 is pivotally coupled on one end to sash arm 14 and shoe pivot 20, by a swivel arm pivot (shown as rivet 30). Sash arm 14 may have alternate positions for apertures 15 to which swivel arm 28 may be connected (e.g., by rivet 30) to provide for different positioning of the window sash with respect to the window frame at and during opening. Swivel arm 28 is connected, on the opposite end, to track assembly 22 by adjustment stud 100.

Typically associated with a casement window is an operating mechanism (not shown) that allows opening and closing of the window sash with respect to the window frame in a motion or profile characterized by both rotating and translating of the window sash with respect to the window frame. The operating mechanism imparts motion of the window sash constrained by shoe assembly 18. (Shoe assembly 18 is constrained to move along track assembly 22). As depicted in FIG. 13, shoe assembly 18 preferably has a finger section 18*a*. According to a particular preferred embodiment, shoe assembly 18 is made from a glass-filled nylon or equivalent material. Track 22 preferably has a coacting finger engagement section 22*a* that retains finger section 18*a* to ride in coacting finger engagement section 22*a*. This allows shoe assembly 18 to slide along track 22 but retains shoe assembly 18 thereto. Sash arm 14 responds to the motion of shoe assembly 18 by rotating about swivel arm pivot 30 and translating with respect to track assembly 22. Window sash 12 responds to the rotation and translation of sash arm 14 by rotating with sash arm 14 (to which it is affixed) and possibly translating with respect to fixed window frame 24. The totality of the above motions results in the opening or closing of window sash 12. A pivot stop 32 (shown as a protrusion or nub formed therein) is included in sash arm 14.

Figure 3D:
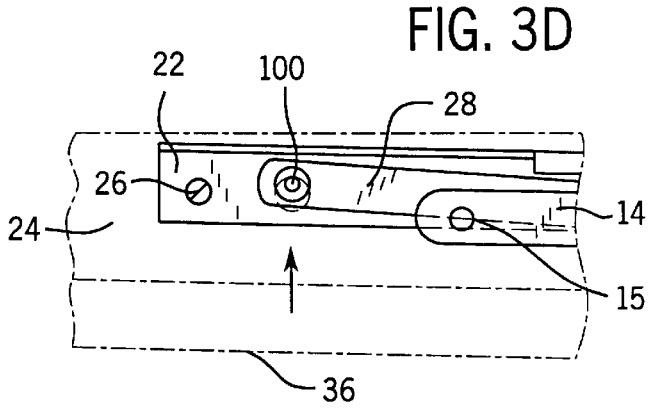
Figure 3B:
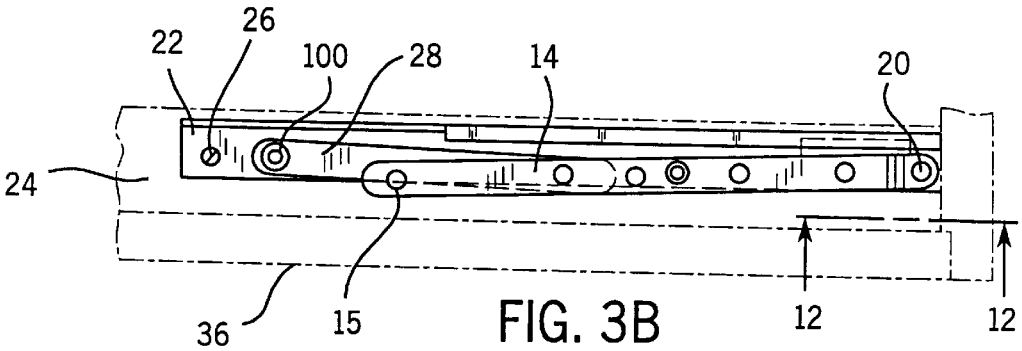

FIG. 3A depicts the configuration of the arms and pivots of the window hinge when window sash (not shown) is in an open position. FIGS. 3B through 3D depict the configuration of the arms and pivots of the window hinge when window sash 12 (not shown) is in a closed position. FIG. 3B depicts a closed window sash 12 preferably aligned, that is with an outer sash face 34 of sash 12 substantially parallel with an outer frame face 36. Misalignments of sash 12 with respect to frame 24 may be a result of what is termed "sash sag". "Sash sag" is a condition whereby a casement window (e.g., sash with respect to frame) is misaligned when closed, caused by wear and tear, assembly misalignment, window frame motion, or window sash expansion, contraction, or warping. Changing the orientation of the adjustment stud, designated by reference numeral 100 in FIGS. 1 through 13 and reference numeral 200 in FIGS. 14 through 17, has the effect of changing the alignment of outer sash face 34 with outer frame face 36.

FIGS. 4 and 5 depict a first embodiment of adjustment stud 100 having a two-piece configuration. Depicted in FIG. 5, an insert 111 includes a substantially cylindrical tenon 112 preferably made from a metal alloy, but alternatively made from other suitable materials such as, but not limited to, any of numerous polymers, ceramics, metals, and ceramic, polymer or metal composites. (According to a particular preferred embodiment, insert 111 is made from copper alloy 642 Everdur 1014 bronze, 360 free machining brass, or an equivalent material). Insert 111 is bonded to a cap 113 that includes a flange 114 and a substantially cylindrical post 116. Cap 113 is preferably made from a molded polymer material, but alternatively made from materials such as, but not limited to, any of numerous polymers, ceramics, metals, and ceramic, polymer or metal composites. (According to a particular preferred embodiment, cap 113 is made from a nylon 6/6 33% glass-filled Wellamid GF33-66 22LH-N or equivalent material).

The central axis of tenon 112 is located eccentrically with respect to the central axis of post 116. Adjustment stud 100 also includes arcuate sections shown as wedge-shaped fingers 118, separated by slots 120, each having a ridge 122. Wedge-shaped fingers 118 surround a substantially circular center section 124 that has a tool access region, shown as aperture 126. Depicted in FIG. 4, aperture 126 is a hexagonally-shaped recessed region formed to accept an Allen wrench (or like tool). Alternatively, tool access region may be formed as a slot to accept a regular screwdriver, as crossed slots to accept a Phillips head screwdriver, as a star shaped slot to accept a torque driver, as a square aperture to accept a square head screwdriver, as a partial slot to accept a security screwdriver, as a square or hexagonal head to engage a socket wrench, or as other suitable configurations to accept other respectively appropriate tools. Ridge 122 is designed to engage swivel arm 28 such that swivel arm 28 is not inadvertently disengaged from stud 100.

Tenon 112 interconnects track assembly 22 through a hole 128 in track assembly 22, depicted in FIG. 2. Tenon 112 is installed within hole 128 by a staking process. The staking process consists of first inserting a tenon such as tenon 112 into a substantially circular aperture, such as aperture 128 in track assembly 22. Next the stud is compressed, using a suitable tool or machine, in a direction substantially parallel to the axis of the post until a compressed region 127, shown in FIGS. 6 and 7, or in an alternative embodiment a compressed region 227 shown in FIG. 16, is formed. When properly staked the tenon is frictionally secured to track assembly 22 because of interference created between the tenon and the sides defining aperture 128 in track assembly 22. Once staked, adjustment stud 100 or adjustable 200 will not freely turn (i.e., for adjustment) unless provided with a substantial torque. Alternatively, a thermal contraction fit, or any other technique that creates an interference fit of tenon 112 in aperture 128, can be used. (Preferably, adjustment may be made at least six times before the integrity of the interference is lost.)

When the window shows misalignment due to "sash sag" or other misalignment problems, the adjustment stud may be reoriented to correct the misalignment. FIGS. 6 and 7 depict the adjustment stud in an orientation that moves the outer sash face away from the track assembly when the window is in the closed position as depicted in FIG. 3C. As depicted in FIGS. 6 and 7, when the adjustment stud is in the orientation shown, post 116 is positioned at a maximum travel distance A, shown as measured from a track lip 130. For user convenience, flange 114 may be provided with an indicator that indicates the orientation of adjustment stud 100. Depicted in FIG. 5, the type of indicator used is a flat side 132 of flange 114. Provided with a marker 132, a user can obtain a visual indication of the relative orientation of adjustment stud 100. For example, as depicted in FIG. 7, when flat side 132 is parallel to and on a side furthest from track lip 130, a user can see that adjustment stud 100 is in an orientation in which post 116 is at maximum distance 129 from track lip 130. It should be noted that the correspondence or calibration of the indicator is not limited to the orientation depicted, but may be placed in any orientation. Further, adjustment stud 100 may be provided with an indicator but the indicator type is not limited to indicators of the type depicted. Ink marks, notches, indentations, dial points, and other appropriate markers may be alternatively used in place of flat side 132.

FIGS. 8 and 9 depict the adjustment stud in an orientation that moves outer the sash face closer to the track assembly when the window is in the closed position as depicted in FIG. 3D. As depicted in FIGS. 8 and 9, when the adjustment stud is in this orientation, post 116 is positioned at a minimum travel distance B, as measured from track lip 130. Depicted in FIG. 9, flat side 132 is parallel to and on a side nearest track lip 130. The orientation of flat side 132 depicted, indicates that adjustment stud 100 is in which post 116 is at minimum distance B from track lip 130.

FIGS. 14 through 17 depict an alternative embodiment of an adjustment stud 200. Adjustment stud 200, as depicted, has an insert 211 and a cap 213. (Adjustment stud 200 is not limited to two members, but may alternatively be constructed from a plurality of pieces or a single piece.) According to a particular preferred embodiment, adjustment stud 200 is integrally-formed from a silicone bronze material. Adjustment stud 200 is similar to adjustment stud 100, having a tenon 212, a flange 214, a post 216, and a flat side 232. The central axis of tenon 212 is similarly offset from the central axis of post 216. Adjustment stud 200 operates in a similar manner as adjustment stud 100.

Adjustment stud 200 has (on post 216) a circumferential groove 222, as depicted in FIG. 14. Groove 222 engages a clip 224 that is slidably interconnected with swivel arm 28. Clip 224 has roughly "C"-shaped edges 234 that hold clip 224 to swivel arm 28 while allowing clip 224 to slide along sash arm 128 when the clip is disengaged from clip 224, as depicted in FIG. 15. Clip 224 also has a pair of flexible opposed arms 235 such that when clip 224 is slid to engage post 216, arms 235 are forced apart by interference with post 216. Arms 235 then return to substantially their original positions, but engaged in groove 222. When clip 224 is engaged, swivel arm 28 is retained on adjustment stud 200, as depicted in FIG. 14. However, when clip 224 is engaged with groove 222 swivel arm 28 remains rotatable about post 216. To facilitate engagement and disengagement of clip 224 from adjustment stud 200, the clip preferably has a tool engagement site 236. As depicted in FIGS. 14 and 15, tool engagement site 236 is formed to accommodate a regular screwdriver, but any other suitable type of tool engagement site may be used.

For window frames that have a joint or bead which may interfere with installation of the track assembly, an embodiment of track assembly 22 is shown in FIGS. 10 through 12 which will solve the interference problem. FIGS. 10 through 12 depict track assembly 22 having a cutout region 22*a*, defined by a tail section 23 and a shoulder section 25. Cutout region 22*a* is formed so that track assembly 22 may abut a vertical portion 24*a*, of window frame 24, while avoiding a joint bead 24*b*. Joint bead 24*b* is formed when window frame 24 is assembled from vertical portion 24*a* and a horizontal portion 24*c* that meet at joint 24*d*. Window frame 24 is preferably made from a vinyl polymer, but frame 24 may be alternatively made from wood, other polymers or polymer composites, metals or metal alloys, ceramics or ceramic composites, or other suitable materials. When vinyl polymers are used to form window frame 24, vertical portions 24*a* and horizontal portions 24*c* may be bonded through friction welding, melting, application of bonding adhesives, or other suitable methods. Many of these methods require a bead 24*b* to be formed.

Similarly to avoid interference with bead 24*b*, depicted in FIG. 12, shoe assembly 18 preferably has a tail section 18*b* and a shoulder section 18*c* that define a cutout region 18*e* of shoe assembly 18. Cutout region 18*e* is formed so that shoe assembly 18 may abut vertical portion 24*a* of window frame 24 when the window is in the closed position, as depicted in FIG. 12. Cutout region 18*e* of shoe assembly 18 avoids having the shoe interfere with bead 24*b*.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of the invention as defined in the following claims. In the claims, each means-plus-function clause is intended to cover the structures described herein as performing the recited function and not only structural equivalents but also equivalent structures.

Other substitutions, modifications, changes and omissions may be made in the design, operating conditions and arrangement of the preferred embodiments without departing from the spirit of the invention as expressed in the appended claims.

What is claimed is:

1. An apparatus for retaining at least two linkages in rotational relation to one another, the apparatus comprising:

a first linkage with at least one substantially circular aperture;

a second linkage with at least one substantially circular aperture;

an adjustment stud including a substantially cylindrical post having a first post end, a second post end, and defining a pivot axis extending centrally and longitudinally through both the first post end and the second post end, a substantially cylindrical tenon having a first tenon end, a second tenon end, and defining an adjustment axis extending centrally and longitudinally through both the first tenon end and the second tenon end;

a clip, slidably movable in a longitudinal direction along the first linkage to engage or disengage the first post end;

wherein the post and the tenon are interconnected adjacent their respective second ends such that the pivot axis and adjustment axis are substantially parallel and eccentric with respect to one another;

wherein the first post end of the post extends through the aperture in the first linkage, and the clip is rotatably engageable with the first post end of the post;

wherein the post is held in pivotable retention by the clip;

wherein the first tenon end of the tenon extends through the aperture in the second linkage;

wherein the tenon is frictionally bound from freely rotating, in relation to the second linkage; and wherein the stud is selectively and continuously adjustable by rotation of the stud in relation to the second linkage under a substantial torque.

2. The apparatus of claim 1 wherein the adjustment stud is constructed as a single member.

3. The apparatus of claim 1 wherein the post is a substantially compliant material and the tenon is a substantially rigid material forming the adjustment stud as two separate members having differential wear or performance characteristics.

4. The apparatus of claim 1 wherein the adjustment stud has a recess on the first post end formed to engage a tool.

5. The apparatus of claim 4 wherein the recess on the first post end of the post of the adjustment stud is formed to engage with an allen wrench.

6. The apparatus of claim 1 wherein the adjustment stud is retained in a pivotable relationship with the first linkage by a ridge on the post engaging the clip on the first linkage.

7. An adjustment stud for the adjustment of a casement window to reduce sash sag, the adjustment stud being frictionally retained from free rotational motion in a second linkage, but adjustably rotatable under substantial torque, and the adjustment stud pivotally retaining a first linkage, the adjustment stud comprising:

a substantially cylindrical post having a first end, a second end, and defining a pivot axis extending centrally and longitudinally through both the first end and the second end, and having a first end formed to engage an adjustment tool and the fist end pivotally retaining the first linkage;

a substantially cylindrical tenon having a first end, a second end, and defining an adjustment axis extending centrally and longitudinally through both the first end and the second end, the first end of the tenon being substantially frictionally retained by the second linkage;

wherein the post and the tenon are interconnected adjacent their respective second ends such that the pivot axis and adjustment axis are substantially parallel and eccentric with respect to one another, the post and the tenon are made as at least two separate members that are formed together to form the adjustment stud, the post being of a first material and the tenon being of a second material, the second material having a differential wear or performance characteristic than that of the first material.

8. The adjustment stud of claim 7 wherein the adjustment stud is made as a single member.

9. The adjustment stud of claim 7 further comprising:

a flange disposed between the post and the tenon.

10. The adjustment stud of claim 7 wherein the adjustment stud has an indicator for visual alignment of the adjustment stud.

11. The adjustment stud of claim 7 wherein the first end of the post is formed to engage with an allen wrench.

12. The adjustment stud of claim 7 wherein the post has a circumferential groove to engage a clip.

13. The adjustment stud of claim 7 wherein the post has flexible sections around the periphery of the post to retain the first linkage.

14. The adjustment stud of claim 7 wherein the post is formed of a compliant material, and the tenon is formed of a metallic material.

15. The adjustment stud of claim 14 wherein the post is formed of a nylon material, and the tenon is formed of a copper alloy material.

16. The adjustment stud of claim 15 wherein the nylon material is a reinforced nylon material.

17. A hinge for a casement window of a type including a frame and a sash rotatable within the frame comprising:

a track assembly, attachable to a window frame and having at least one substantially circular aperture;

a swivel arm, having at least one substantially circular aperture;

an adjustment stud including a substantially cylindrical post having a first end, a second end and a recess on the first end of the post formed to engage an adjustment tool, and defining a pivot axis extending centrally and longitudinally through both the first end and the second end, a substantially cylindrical tenon having a first end, a second end, and defining an adjustment axis extending centrally and longitudinally through both the first end and the second end, and a flange, interconnecting the post and the tenon; and a clip slidably movable in a longitudinal direction along the swivel arm to engage or disengage the first post end, wherein the post and the tenon are interconnected to the flange adjacent their respective second ends such that the pivot axis and adjustment axis are substantially parallel and eccentric with respect to one another;

wherein the first end of the post extends through the aperture in the swivel arm;

wherein the post is pivotally coupled to the swivel arm and retained by the clip;

wherein the first end of the tenon extends through the aperture in the track assembly;

wherein the tenon is frictionally bound from freely rotating, in relation to the track assembly; and wherein the stud is selectively and continuously adjustable by rotation of the pivot axis around the adjustment axis under a substantial torque.

18. The hinge of claim 17 wherein the post is a first member formed of a compliant material and the tenon is a second member formed of a metallic material.

19. The hinge of claim 17 wherein the post has flexible sections around the periphery of the post to retain the swivel arm.

* * * * *